US010180306B2

(12) United States Patent
Ben Zion et al.

(10) Patent No.: US 10,180,306 B2
(45) Date of Patent: Jan. 15, 2019

(54) ILLUMINATED WEAPON SIGHT

(71) Applicant: MEPROLIGHT (1990) LTD., Or-Akiva (IL)

(72) Inventors: Yuval Ben Zion, Shoam (IL); Zeev Pniel, Petah Tikva (IL); Doron Segal, Netanya (IL)

(73) Assignee: MEPTOLIGHT (1990) LTD., Or-Akiva (IL)

( * ) Notice: Subject to any disclaimer, the term of this patent is extended or adjusted under 35 U.S.C. 154(b) by 0 days.

(21) Appl. No.: 15/737,317

(22) PCT Filed: Jun. 27, 2016

(86) PCT No.: PCT/IL2016/050685
§ 371 (c)(1),
(2) Date: Dec. 18, 2017

(87) PCT Pub. No.: WO2017/006310
PCT Pub. Date: Jan. 12, 2017

(65) Prior Publication Data

US 2018/0172399 A1 Jun. 21, 2018

(30) Foreign Application Priority Data

Jul. 9, 2015 (IL) ..... 239879

(51) Int. Cl.
*F41G 1/01* (2006.01)
*F41G 1/10* (2006.01)
*F41G 1/34* (2006.01)

(52) U.S. Cl.
CPC ..... *F41G 1/345* (2013.01); *F41G 1/01* (2013.01); *F41G 1/10* (2013.01)

(58) Field of Classification Search
CPC ..... F41G 1/345
See application file for complete search history.

(56) References Cited

U.S. PATENT DOCUMENTS 3,994,072 A * 11/1976 Agnello, Jr. ..... F41G 1/345 42/132
4,713,889 A * 12/1987 Santiago ..... F41C 33/0227 224/246
5,735,070 A * 4/1998 Vasquez ..... F41A 9/62 42/1.02
6,412,208 B1 * 7/2002 Mikuta ..... F41G 1/345 42/132

(Continued)

FOREIGN PATENT DOCUMENTS

EP 2 878 913 A1 6/2015
FR 2481435 A1 * 10/1981 ..... F41G 1/345
WO 2015/055596 A1 4/2015

*Primary Examiner* — Joshua T Semick
(74) *Attorney, Agent, or Firm* — Soroker Agmon Nordman

(57) ABSTRACT

A sighting system for use with firearms having a barrel for releasing a projectile toward a target, including an LED light, a power source for powering the LED light, a circuit that receives power from the power source and provides it to the LED light and controls the LED light, a housing for encasing the LED light, power source and circuit to act as an independent unit, wherein the housing is designed to be retrofit entirely on top of the barrel of the firearm, so that in dim light a user is guided by light from the LED light to align the barrel toward the target.

20 Claims, 7 Drawing Sheets

(56) References Cited

U.S. PATENT DOCUMENTS

| | | | | |
|---|---|---|---|---|
| 6,571,504 | B2 * | 6/2003 | Carlson | F41G 1/345 42/132 |
| 6,640,482 | B2 * | 11/2003 | Carlson | F41G 1/345 42/132 |
| 7,562,486 | B2 * | 7/2009 | LoRocco | F41G 1/345 42/132 |
| 7,627,976 | B1 * | 12/2009 | Olson | F41G 1/345 42/132 |
| 9,212,867 | B2 * | 12/2015 | Patterson | F41G 1/345 |
| 9,291,424 | B2 * | 3/2016 | Tagarro | F41J 5/10 |
| 9,316,461 | B1 * | 4/2016 | Gwillim, Jr. | F41G 1/345 |
| 9,453,706 | B1 * | 9/2016 | Crispin | F41G 1/06 |
| 9,500,442 | B2 * | 11/2016 | Collin | G03H 1/0005 |
| 9,638,492 | B2 * | 5/2017 | Jones | F41G 1/345 |
| 10,088,275 | B1 * | 10/2018 | Warren | F41C 3/00 |
| 2012/0198750 | A1 | 8/2012 | Mansfield | |
| 2015/0109602 | A1 * | 4/2015 | Martin | F41G 1/345 356/3 |

* cited by examiner

ILLUMINATED WEAPON SIGHT

TECHNICAL FIELD

The present invention relates to an illuminated sighting system and more particularly to an illuminated sighting system for use with firearms.

BACKGROUND

When using small firearms such as handguns it is the interest of the user to aim the barrel of the handgun so that bullets fired will hit a desired target. Typically, firearms include at least one sight on top of a distal end of the barrel of the firearm for aligning the barrel with the target Many sighting systems further include a second rear sight closer to the shooter for enabling the user to fire more accurately at the target. Optionally, the front sight at the distal end of the barrel may include a single point protruding upward from the barrel, whereas the rear sight may include a pair of points protruding upward from the barrel. During use the user aligns the barrel so that the single point will appear in the user's eyes to be positioned between the pair of rear points.

The sighting system that is provided as an integral part of the firearm is usually the same color as the firearm barrel. Generally it usually takes a relatively long time for the user to focus on the points and align them before shooting. This situation is undesirable since the firearm may be required in life threatening situations where split seconds could mean the difference between life and death. Additionally, in poor lighting conditions it may be impossible to use the sighting system.

Optionally the points may be marked with colored fluorescent paint to increase visibility and enhance alignment speed. However in poor lighting conditions or in the dark the colored points may fail to increase visibility effectively.

In some sighting systems small tubes with a radioactive gas, such as tritium are used to form illuminated points so that in poor lighting conditions the points are visible and the speed of aiming the firearm is enhanced. The decay of the radioactive gas causes a fluorescent material to glow so that the points appear to be illuminated. However the radioactive illumination is relatively weak and not noticeable in bright light conditions. Additionally, the use of radioactive materials is restricted in some countries and/or requires extensive regulatory procedures, which deter the commercialization of this solution. Thus it is desirable to form illuminated sights without the use of radioactive materials and optionally having different levels of illumination.

SUMMARY

An aspect of an embodiment of the disclosure relates to a sighting system for use with a firearm to help aim the firearm toward a target. The sighting system includes at least one sight having the following elements: an LED (light emitting diode) light, a power source such as a battery to power the light, a circuit to control the LED light and a housing to encase the elements into a single independent unit, which provides an illumination point from the light of the LED. In an exemplary embodiment of the disclosure, the sighting system includes one or two sights: a front sight with a single illumination point and/or a rear sight with a pair of illumination points. Optionally, the rear sight is designed with a void (e.g. a U shaped void) between the two points so that a user can align the front point between the pair of rear points when aiming at a target. In some embodiments of the disclosure, any of the sights may have one or more illumination points that are illuminated by LED lights, for example the front may have 3 illumination points and the rear sight may have 4 illumination points.

In an exemplary embodiment of the disclosure, the LED lights are always on. Alternatively, they are activated for a predetermined amount of time (e.g. 1 hour, 1 day) upon sensing motion of the sight by a motion sensor on the circuit. In some embodiments of the disclosure, the LED lights are activated responsive to the status of the light surrounding the sight, for example the LED is activated when it is darker than a predetermined level that is sensed by a light sensor. In some embodiments of the disclosure, the sights include an activation switch for activating and deactivating the sights.

In an exemplary embodiment of the disclosure, the LED lights used for the front sight may have a different color than the LED lights on the rear sight. Alternatively, the LED light is white and a color filter is used to change the color viewed by the user.

There is thus provided according to an exemplary embodiment of the disclosure, a sighting system for use with firearms having a barrel within a slide for releasing a projectile toward a target, comprising:

An LED light;

A power source for powering the LED light;

A circuit that receives power from the power source and provides it to the LED light and controls the LED light;

A housing for encasing the LED light, power source and circuit to act as an independent unit; wherein the housing is designed to be retrofit entirely on top of the side of the firearm, so that in dim light a user is guided by light from the LED light to align the barrel toward the target.

In an exemplary embodiment of the disclosure, the housing is positioned at a distal end of the barrel to serve as a front sight and wherein a second housing comprising an LED light, a power source and a circuit is positioned at another end of the barrel near the user to serve as a rear sight; and wherein the user is guided by the LED light from the front sight and the rear sight together to align the barrel toward the target. Optionally, the front sight emits light from a single point on the housing and the rear sight emits light from two points on the housing.

In an exemplary embodiment of the disclosure, the housing of the rear sight is designed to form a void between the two points of the rear sight for aligning the light from the single point of the front sight to be viewed by the user between the two points of the rear sight. Optionally, the power source is heat insulated.

In an exemplary embodiment of the disclosure, the circuit includes a motion sensor to activate, deactivate or control an illumination level of the LED light responsive to motion detection. Optionally, the circuit includes a light sensor to activate, deactivate or control an illumination level of the LED light responsive to the intensity of ambient light surrounding the housing.

In an exemplary embodiment of the disclosure, the power source is connected to the circuit with rigid connectors to withstand recoil of the firearm. Optionally, the sighting system includes a screw to anchor the housing relative to the slide. In an exemplary embodiment of the disclosure, the Led light is activated or deactivated based on the status of the screw. Optionally, the color of the light is user selectable. In an exemplary embodiment of the disclosure, the color of the light of the front sight is different than the color of the light of the rear sight. In an exemplary embodiment of the disclosure, the housing is filled with a filling material.

Optionally, the sighting system includes a focusing lens to focus the light provided by the LED light.

In an exemplary embodiment of the disclosure, the front sight and rear sight are provided together as a kit for a specific model of firearm. Optionally, the kit further comprises a charger to recharge the power source of the front sight and/or rear sight. In an exemplary embodiment of the disclosure, the sighting system includes a fiber optic guide for providing light for view by the user. In an exemplary embodiment of the disclosure, the fiber optic guide accepts ambient light into the fiber optic guide in addition to the light from the LED. Optionally, the Led light is activated when assembled on a firearm by using the slide of the firearm to close an electrical circuit.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear. It should be noted that the elements or parts in the figures are not necessarily shown to scale and element or part may be relatively larger or smaller than actually shown.

DETAILED DESCRIPTION

Figure 1:
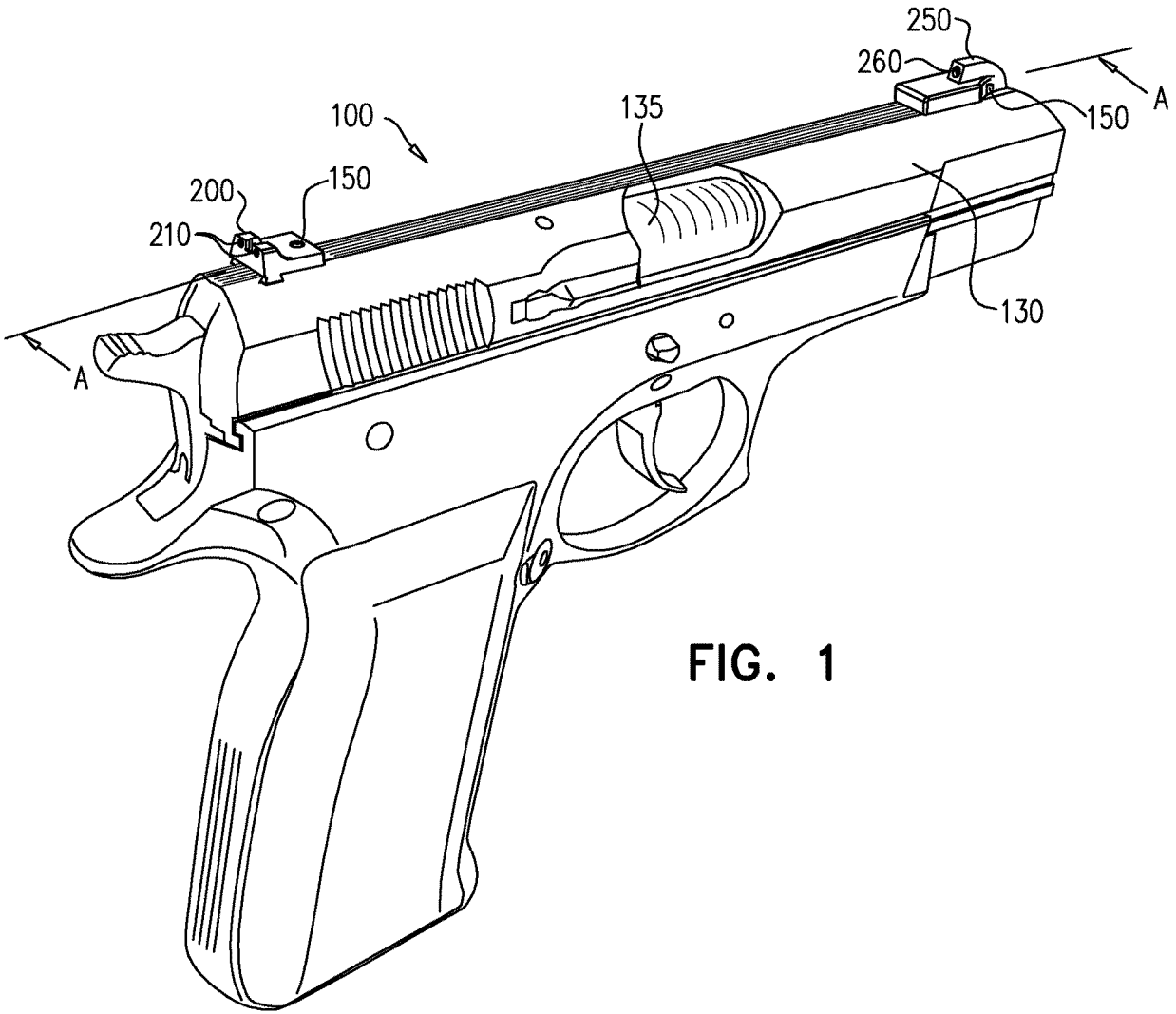
FIG. 1 is a schematic illustration of a firearm incorporating a sighting system, according to an exemplary embodiment of the disclosure.
Figure 4:
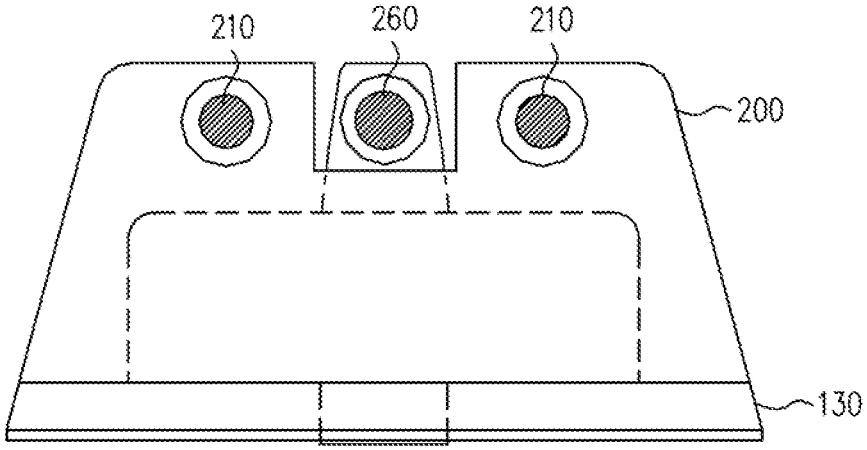
FIG. 4 is a schematic illustration of a front view of the sighting system of FIG. 1, according to an exemplary embodiment of the disclosure.

FIG. 1 is a schematic illustration of a firearm 100 incorporating a sighting system 150, according to an exemplary embodiment of the disclosure. Firearm 100 includes a barrel 135 within a slide 130 and the sighting system 150 is retrofit on top of the slide 130 for a user to use to aim at a target. Sighting system 150 may include a single sight or may include a front sight 250 and a rear sight 200. Optionally, the front sight 250 includes a single illuminated point 260 and the rear sight includes a pair of illuminated points 210, each point extending upward from the be slide 130 with a void (e.g. U shaped) between the points 210. In an exemplary embodiment of the disclosure, when aiming at the target the user views the illuminated points (210, 260) and aims the firearm 100 by aligning point 260 to appear to the user to be located in the void between the pair of points 210 (e.g. as shown in FIG. 4). In an exemplary embodiment of the disclosure, the rear sight 200 and the front sight 250 are independent wherein illuminated points (210, 260) output light that is provided by LED lights that are embedded inside the sight (200, 250) and powered internally. Optionally, the light output from illuminated points (210, 260) is marked by a surrounding bright colored circle to enhance visibility, for example a reflector or a fluorescent circle that absorbs ambient light and can glow for a short time in the dark.

Figure 2A:
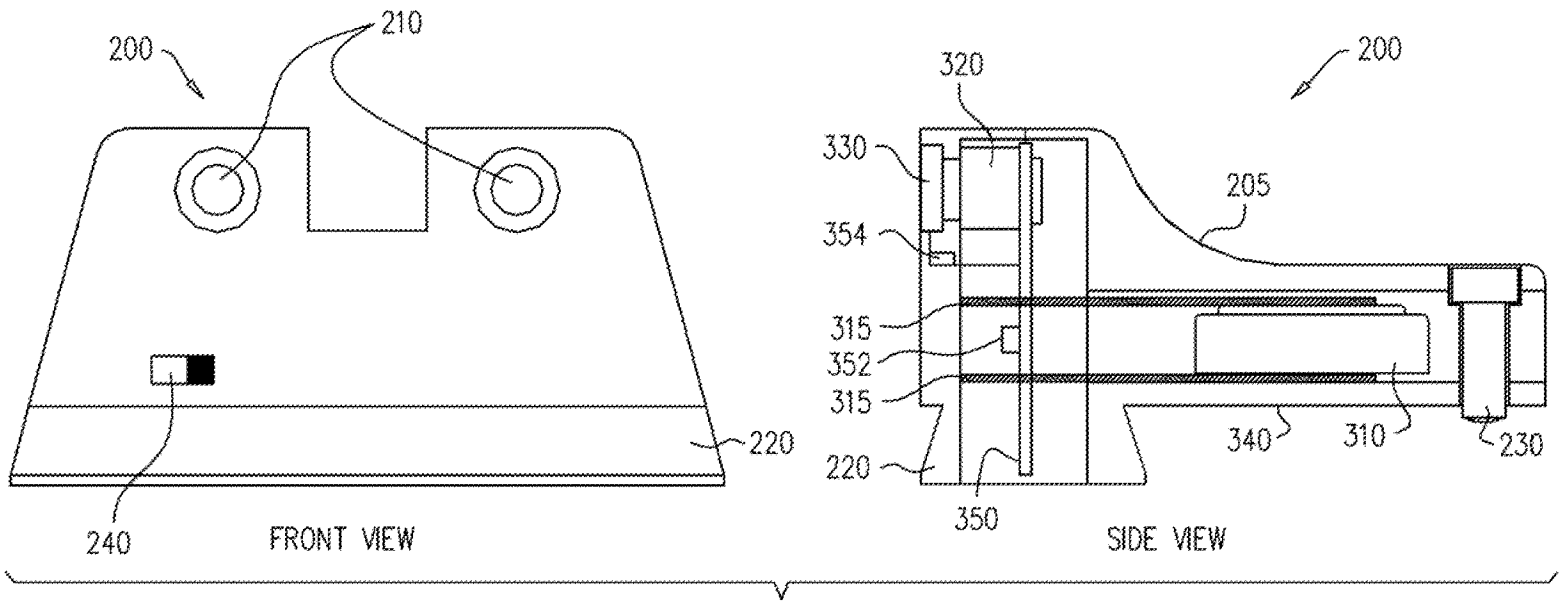
FIG. 2A is a schematic illustration of a front view and side view of a rear sight of a sighting system, according to an exemplary embodiment of the disclosure.
Figure 2B:
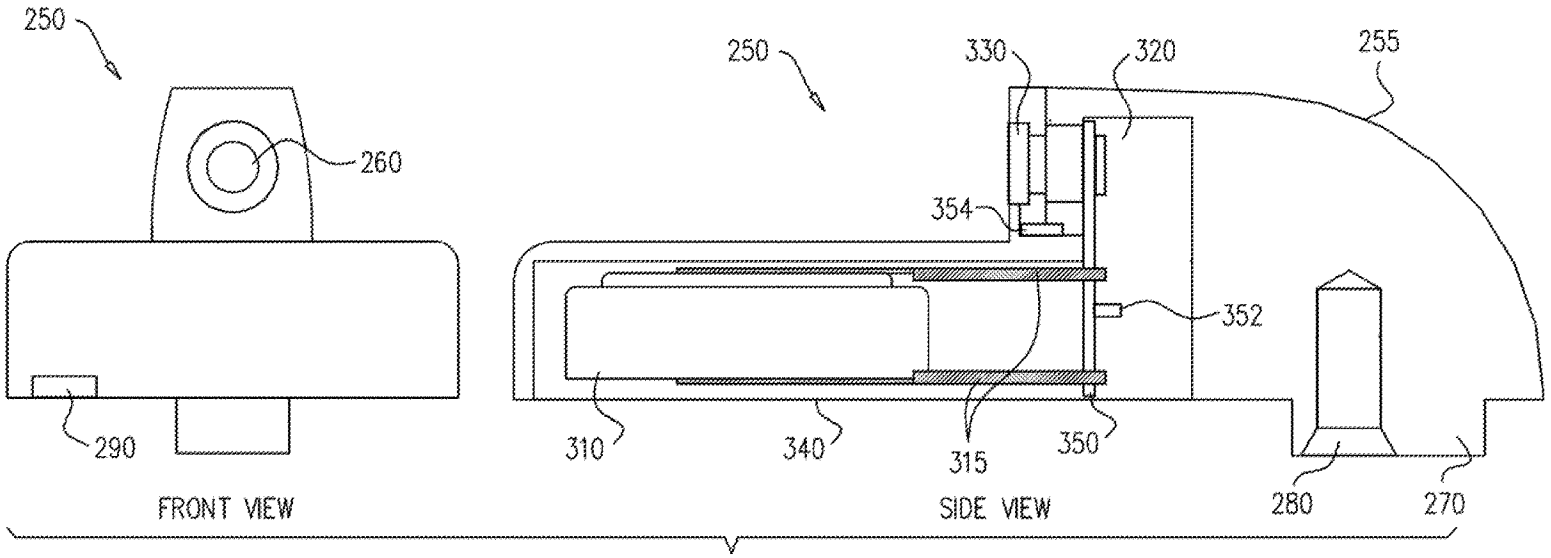
FIG. 2B is a schematic illustration of a front view and side view of a front sight of a sighting system, according to an exemplary embodiment of the disclosure.

FIG. 2A is a schematic illustration of a front view and side view of a of rear sight 200 of sighting system 150, and FIG. 2B is a schematic illustration of a front view and side view of front sight 250 of sighting system 150, according to an exemplary embodiment of the disclosure. Rear sight 200 and front sight 250 are designed to be retrofit onto standard firearms, for example handguns manufactured by Smith and Wesson, Glock or Browning. Each sight (200, 250) is encased in a protective housing (205, 255) to protect it from moisture and/or impact. Optionally, the protective housing (205, 255) is made from metal or a composite material such as a strong plastic that can withstand heat and impact. In some embodiments of the disclosure, housing (205, 255) is heat insulated to protect its content from the heat of the firearm barrel 135.

Optionally, rear sight 200 and front sight 250 include an attachment system for attaching the sights (200, 250) as retrofits to the slide 130 of firearm 100. For example the attachment system may include a base (220, 270) that is designed to fit into interlocking protrusions on a specific firearm. Additionally, the attachment system may include a screw (230, 280) for anchoring the housing (205, 255) of sights (200, 250) in place, and prevent them from moving during use.

Figure 3:
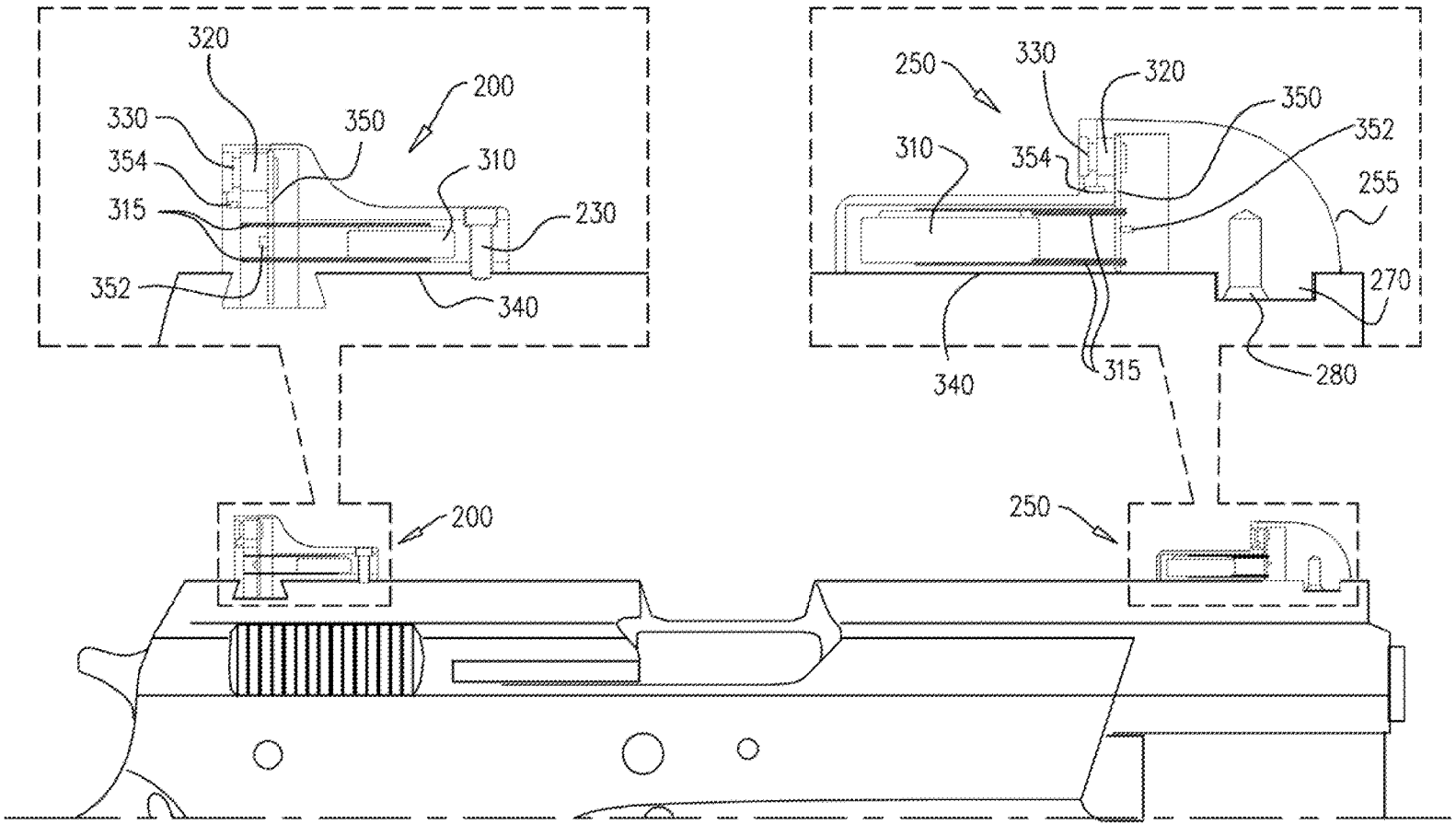
FIG. 3 is a cross sectional view of the sighting system of FIG. 1 taken along lines A-A, according to an exemplary embodiment of the disclosure.

FIG. 3 is a cross sectional view of the sighting system 150 of FIG. 1 taken along lines A-A, according to an exemplary embodiment of the disclosure. As illustrated in FIG. 3 each sight (200, 250) optionally, includes a power source such as a battery 310, a circuit 350, and an LED light 320. In an exemplary embodiment of the disclosure, the battery 310 may be rechargeable or non-rechargeable. Optionally, the LED 320 may be a high efficiency LED 320 so that it uses very little current, for example the current consumption of the LED 320 may be in the order of the self discharge current of the battery 310, so that the battery 310 can power the LED 320 continuously for a few years (e.g. 2-5 years). In an exemplary embodiment of the disclosure, battery 310 is connected to LED 320 with connectors 315 via circuit 350 that controls functionality of the LED 320. Optionally, the connectors 315 are rigid to protect the connection from the backfire of the firearm 100. In some embodiments of the disclosure, the housing may serve to conduct from one of the poles of the battery to reduce the risk of a short from recoil forces.

In some embodiments of the disclosure, sight 200 and sight 250 are manufactured with LED 320 illuminating until the battery 310 is discharged (e.g. after a few years). Alternatively, LED 320 may be activated by the user with a switch (240, 290 shown in FIG. 2A, 2B respectively). Another option is that LED 320 is activated based on the status of screw 230 or screw 280, which anchor sight 200 and sight 250 in place. Optionally, when sight 200 or sight 250 are deployed and screw 230 or 280 is tightened LED 320 is activated. Further alternatively, circuit 350 may include a motion sensor 352 that activates LED 320 for a specific amount of time upon the detection of motion, for example for a few hours or a few days. Optionally, after use (e.g. when firearm 100 is placed in storage) LED 320 will turn off until it is moved again.

In some embodiments of the disclosure LED 320 is activated when the sights (200, 250) are installed using the electrical conductivity of slide 130 to close a circuit In some embodiments of the disclosure, the user can select an illumination level or LED color, for example using switch 240 and/or switch 290. Optionally, LED 320 is a multicolor LED and the color is controlled by circuit 350, for example by setting different voltage levels based on the user's selection. In some embodiments of the disclosure, the color of LED 320 in sight 250 may be set to differ from the color of the LED lights 320 in sight 200, to make it easier to align. Alternatively or additionally, each LED 320 may be set to a different color. Likewise switch 240 and/or switch 290 may be used to increase or decrease the illumination level of LED 320, like a dimmer. Alternatively or additionally, sight 200 and/or sight 250 may include a light sensor 354 (e.g. near lens 330) to enable circuit 350 to control the illumination level of LED 320 in response to the light surrounding housing (205, 255).

In some embodiments of the disclosure, battery 310 is replaceable so that it can be changed when it runs low. Optionally, sight 200 and/or sight 250 may be sealed hermetically to protect them from moisture and make them more robust, so that they are protected from recoil forces. Optionally, the internal elements of the sights (200, 250) are tightly fitted inside housing (205, 255) so that they are not dislocated in response to recoiling of the firearm.

In an exemplary embodiment of the disclosure, the sights (200, 250) include heat insulation 340 to protect battery 310 from the heat released by the barrel 135 during use of the firearm. The heat increases the discharge rate and shortens the life expectancy of the battery 310. In some embodiments of the disclosure, heat insulation 340 also serves as padding for the elements inside housing (205, 255) of sights (200, 250). Alternatively or additionally, housing (205, 255) may be filled with a filling material (e.g. rubber or epoxy) to provide a more robust unit having no empty space.

In some embodiments of the disclosure, sight 200 and/or sight 250 include a focusing lens 330 to focus the light from LED 320. Alternatively, a pin hole/hole in housing (205, 255) may serve to focus the light. Optionally, the light may be focused so that it can only be viewed when looking directly into the illuminated points (210, 260). In some embodiments of the disclosure, the focusing lens 330 may include a color filter to change the color of light viewed by the user.

In an exemplary embodiment of the disclosure, the rear sight 200 and the front sight 250 are each an independent unit and may be used alone or together. Optionally, rear sight 200 and front sight 255 can be marketed together as a kit for a specific model of firearm. The shape of housing (205, 255) may vary depending on the design of firearm 100 for which it is intended. In some embodiments of the disclosure, firearm manufacturers can include rear sight 200 and front sight 250 as part of the firearm 100, for example wherein the sights (200, 250) are welded on or the housing is cast as part of the body of the firearm 100.

In an exemplary embodiment of the disclosure, the housing (205, 255) is designed with a low profile so that it only extends upward from slide 130 by a small amount, for example not adding more than 10-20 percent to the height of slide 130. Optionally, housing (205, 255) is only positioned on top of the slide 130 and does not extend beyond the width of the be slide 130 to either side of the firearm 100. Optionally, rear sight 200 and/or front sight 255 may be mounted on other sighting systems, for example electro-optical systems.

Figure 5:
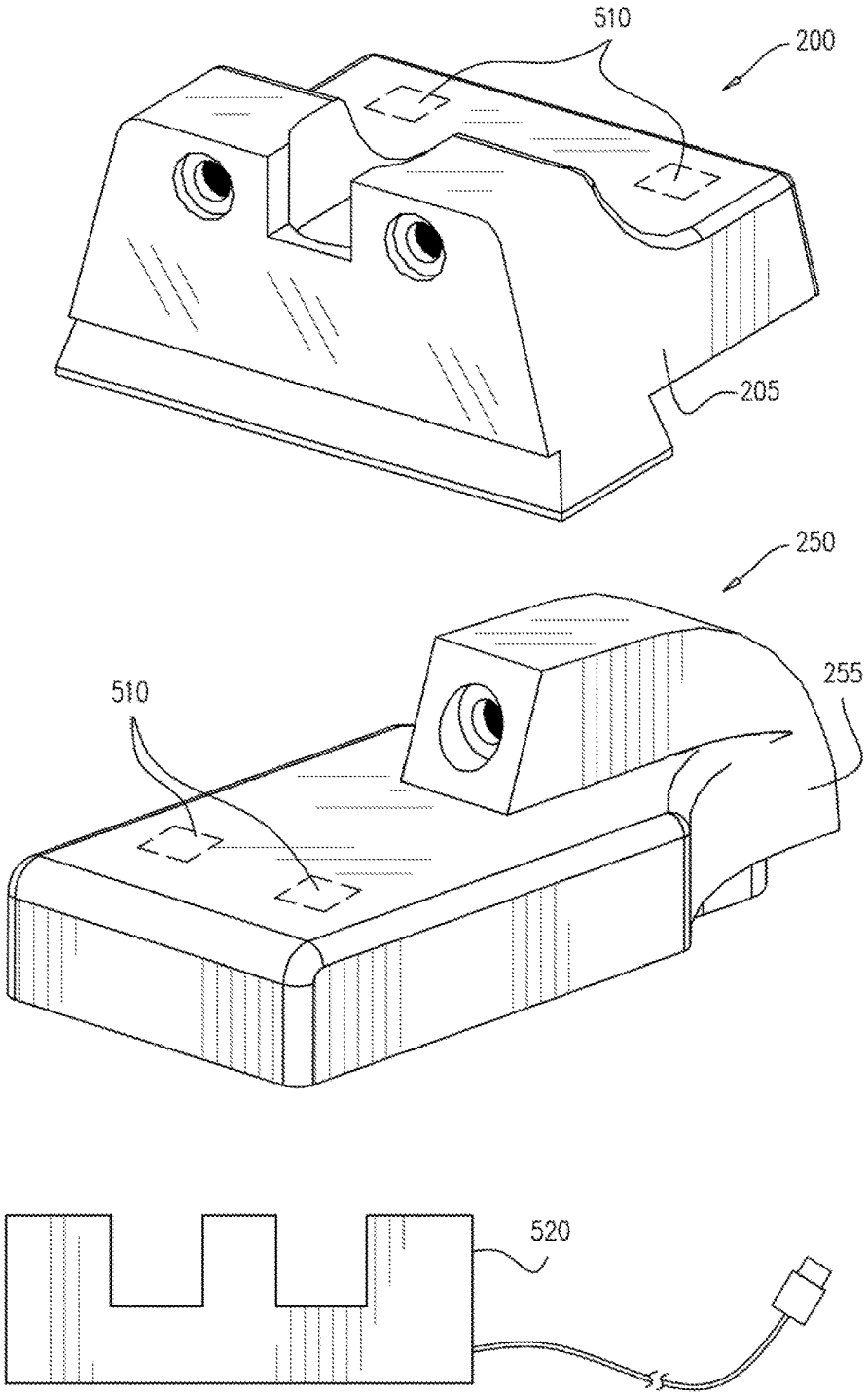
FIG. 5 is a schematic illustration of a sighting system kit with a charger, according to an exemplary embodiment of the disclosure.

In some embodiments of the disclosure, rear sight 200 and front sight 250 include contact points 510 on housing (205, 255) for charging the battery 310. FIG. 5 shows a kit 500 including a rear sight 200, a front sight 250 and a charger 520.

Figure 6:
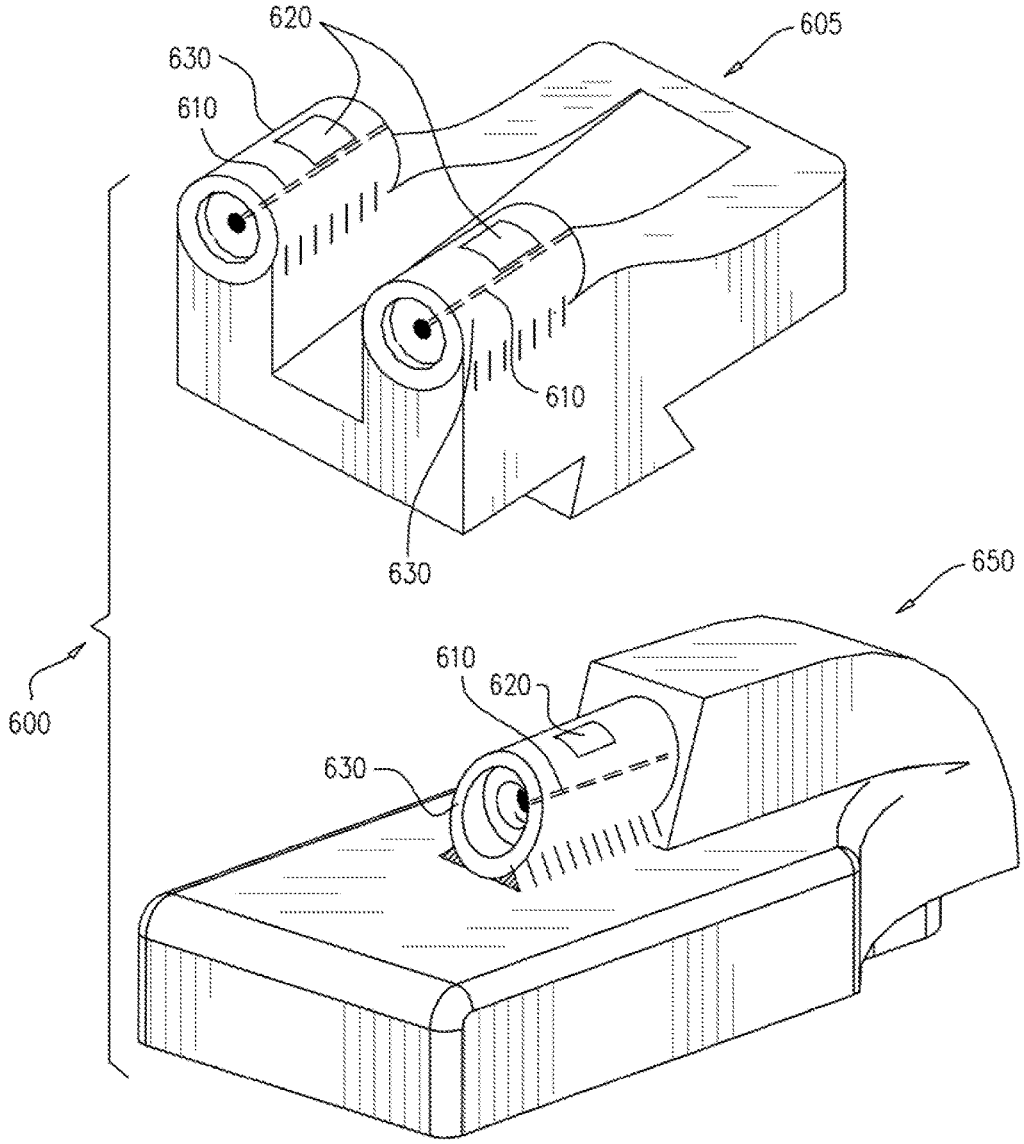
FIG. 6 is a schematic illustration of a sighting system with an optical fiber guide, according to an exemplary embodiment of the disclosure.

FIG. 6 is a schematic illustration of a sighting system 600 with a fiber optic guide 630, according to an exemplary embodiment of the disclosure. In an exemplary embodiment of the disclosure, sighting system 600 includes a rear sight 605 similar to rear sight 200 and a front sight 650 similar to front sight 250, however in sighting system 600 the illumination points (210, 260) are connected to a fiber optic guide 630. Fiber optic guide 630 includes a fiber optic 610 that transfers the light from the LEDs 320 to the end of the fiber optic 610 at the front of the Fiber optic guide 630. In an exemplary embodiment of the disclosure, fiber optic guide 630 also includes a window 620 (e.g. at the top of the fiber optic guide 630) that is configured to allow ambient light to enter the fiber optic 610, for example during daylight to provide a stronger light signal, since the LEDs 320 may be too weak to be seen in daylight. In contrast when the sights (605, 650) are surrounded by darkness the light from the LEDs 320 will shine through.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure. It will also be appreciated by persons skilled in the art that the present disclosure is not limited to what has been particularly shown and described hereinabove.

We claim:

1. A sighting system for use with firearms having a barrel within a slide for releasing a projectile toward a target, comprising:

an LED light;

a power source for powering the LED light;

a circuit that receives power from the power source and provides it to the LED light and controls the LED light;

a housing for encasing the LED light, power source and circuit to act as an independent unit; wherein the housing is designed to be retrofit entirely on top of the slide of the firearm, so that in dim light a user is guided by light from the LED light to align the barrel toward the target; and a screw to anchor the housing onto the slide, the screw configured to engage the slide to prevent the housing from sliding off from the slide; wherein the screw is configured to close the circuit and activate the LED light when the screw is tightened.

2. A sighting system according to claim 1, wherein the housing is positioned at a distal end of the barrel to serve as a front sight and wherein a second housing comprising an LED light, a power source and a circuit is positioned at another end of the barrel near the user to serve as a rear sight; and wherein the user is guided by the LED light from the front sight and the rear sight together to align the barrel toward the targets.

3. A sighting system according to claim 2, wherein the front sight emits light from a single point on the housing and the rear sight emits light from two points on the housing.

4. A sighting system according to claim 3, wherein the housing of the rear sight is designed to form a void between the two points of the rear sight for aligning the light from the single point of the front sight to be viewed by the user between the two points of the rear sight.

5. A sighting system according to claim 1, wherein the power source is heat insulated.

6. A sighting system according to claim 1, wherein the circuit includes a motion sensor to activate, deactivate or control an illumination level of the LED light responsive to motion detection; and wherein the motion sensor activates the LED for a specific amount of time upon detecting motion.

7. A sighting system according to claim 1, wherein the circuit includes a light sensor to activate, deactivate or control an illumination level of the LED light responsive to the intensity of ambient light surrounding the housing.

8. A sighting system according to claim 1, wherein the power source is connected to the circuit with rigid connectors to withstand recoil of the firearm.

9. A sighting system according to claim 1, wherein the color of the light is user selectable.

10. A sighting system according to claim 2, wherein the color of the light of the front sight is different than the color of the light of the rear sight.

11. A sighting system according to claim 1, wherein the housing is filled with a filling material.

12. A sighting system according to claim 1, further comprising a focusing lens to focus the light provided by the LED light.

13. A sighting system according to claim 2, wherein the front sight and rear sight are provided together as a kit for a specific model of firearm.

14. A sighting system according to claim 13, wherein the kit further comprises a charger to recharge the power source of the front sight and/or rear sight; and wherein the housing includes contact points for charging the power source with the charger.

15. A sighting system according to claim 1, further comprising a fiber optic guide for providing light for view by the user.

16. A sighting system according to claim 15, wherein the fiber optic guide accepts ambient light into the fiber optic guide in addition to the light from the LED.

17. A sighting system according to claim 1, wherein the housing is heat insulated to protect encased elements from heat of the barrel.

18. A sighting system according to claim 1, wherein the LED has a current consumption of the order of the self-discharge current of the power source.

19. A sighting system according to claim 1, wherein the housing is filled with epoxy to eliminate empty space.

20. A sighting system according to claim 1, wherein the LED is activated when assembled on the firearm by using conductivity of the slide to close the circuit.

* * * * *